US006227390B1

(12) United States Patent
Trzmiel et al.

(10) Patent No.: US 6,227,390 B1
(45) Date of Patent: May 8, 2001

(54) CLOSURE ARRANGEMENT FOR A CONTAINER WITH CLAMPING PROJECTIONS AND INTERFITTING SLANTED GROOVES

(75) Inventors: Alfred Trzmiel, Grafenberg; Bernd Niethammer, Nürtingen; Winfried Richter, Burgstädt, all of (DE)

(73) Assignee: Hydraulik-Ring GmbH (DE)

( * ) Notice: Subject to any disclaimer, the term of this patent is extended or adjusted under 35 U.S.C. 154(b) by 0 days.

(21) Appl. No.: 09/259,525

(22) Filed: Feb. 26, 1999

(30) Foreign Application Priority Data

Feb. 28, 1998 (DE) ..... 298 03 502 U

(51) Int. Cl.[7] ..... B65D 55/02

(52) U.S. Cl. ..... 215/217; 215/44; 215/45; 215/211; 215/214; 215/222; 215/341; 215/354; 220/293

(58) Field of Search ..... 220/293; 215/211, 215/214, 217, 222, 218, 332, 44, 45, 341, 354

(56) References Cited

U.S. PATENT DOCUMENTS

| | | | | |
|---|---|---|---|---|
| 732,481 | * | 6/1903 | Wiederseim | 215/354 X |
| 784,513 | * | 3/1905 | Brockelbank | 215/332 |
| 1,435,723 | * | 11/1922 | Mayer | 215/332 |
| 1,796,728 | * | 3/1931 | Sharp | 215/44 X |
| 1,842,261 | * | 1/1932 | Garwood | 215/354 |
| 2,109,629 | * | 3/1938 | Anderson | 215/44 X |
| 3,115,981 | * | 12/1963 | Darmstadt et al. | 215/354 X |
| 3,181,725 | * | 5/1965 | Friedl | 220/293 |
| 3,595,417 | * | 7/1971 | Musher | 215/222 |
| 3,927,783 | * | 12/1975 | Bogert | 215/222 |
| 4,473,170 | * | 9/1984 | Ciancimino | 220/293 X |
| 5,398,837 | * | 3/1995 | Degrassi | 215/332 X |
| 5,466,020 | * | 11/1995 | Page et al. | 215/332 X |

FOREIGN PATENT DOCUMENTS

| | | | | |
|---|---|---|---|---|
| 238884 | * | 11/1959 | (AU) | 215/332 |
| 651256 | * | 2/1929 | (FR) | 215/332 |
| 289637 | * | 3/1928 | (GB) | 215/332 |
| 352194 | * | 7/1931 | (GB) | 215/332 |
| 879330 | * | 11/1959 | (GB) | 220/293 |
| 2155985 | * | 10/1985 | (GB) | 215/222 |
| 377131 | * | 12/1939 | (IT) | 215/332 |
| 7610033 | * | 3/1977 | (NL) | 215/222 |

* cited by examiner

*Primary Examiner*—Allan N. Shoap
*Assistant Examiner*—Robin A Hylton
(74) *Attorney, Agent, or Firm*—Robert W. Becker & Associates

(57) ABSTRACT

A closure arrangement for a container has a container neck, having slanted grooves extending in a circumferential direction of the container neck. A removable cap has a clamping projection for each one of the slanted grooves, wherein the clamping projections slide in the slanted groove when the cap is removed from or fastened to the container neck. Each one of the grooves is delimited by two opposed slanted surfaces. The width of the slanted grooves measured in the circumferential direction matches the size of the clamping projections in the circumferential direction.

15 Claims, 1 Drawing Sheet

CLOSURE ARRANGEMENT FOR A CONTAINER WITH CLAMPING PROJECTIONS AND INTERFITTING SLANTED GROOVES

BACKGROUND OF THE INVENTION

The present invention relates to a closure arrangement for a container having a neck provided over its circumference with two slanted surfaces that have correlated therewith two clamping projections of a removable closure cap which slide along the slanted surfaces for closing and opening the container.

In such known closure arrangements the closure cap is provided with two clamping projections which are embodied like brackets and which can be positioned in a certain orientation axially onto the container neck. Subsequent rotation of the closure cap results in the clamping projections being moved along to diametrically opposed slanted surfaces so that the closure cap not only performs a rotary movement but at the same time an axial movement. In this context, closure caps are known that have an insert projecting into the container neck. At the circumference of the cap insert a sealing ring is positioned which in the closed position of the closure cap sealingly rests at the inner wall of the container neck. The removal of the closure cap, in general, is carried out after extended closing periods so that the friction at the inner wall that might be caused by possible adhesion must be overcome by this sealing ring. It is possible that the closure cap is not easily accessible. For example, the aforementioned containers are used in the motor vehicle sector and are provided at locations that are difficult to access such as, for example, hydraulic oil containers. When the closure cap of such a container must be removed, it is very difficult to overcome this frictional force between the sealing ring and the inner wall of the container. For removal of the closure cap it is not only required to perform a rotary movement but also a subsequent axial movement in order to remove the closure cap from the container. It has been found that very high pulling forces are required for removing the closure cap. When the closure cap is difficult to access, it is generally also impossible to employ a tool for removal of the closure cap.

It is therefore an object of the present invention to embody the closure arrangement of the aforementioned kind such that the closure cap can be removed with minimal force application even at locations that are difficult to access.

SUMMARY OF THE INVENTION

This object is inventively solved in that each slanted surface has positioned opposite thereto at a spacing a further slanted surface, so that the slanted surfaces delimit a groove at the circumference of the container neck, and that in the circumferential direction of the container neck the width of the groove matches the width of the clamping projection of the closure cap.

The inventive closure arrangement is characterized in that at the circumference of the container neck two diagonally opposed grooves are provided which are delimited respectively by two slanted surfaces. The two grooves at the circumference of the container neck thus extend spirally. Since their width matches the corresponding dimension (size) of the clamping projection of the closure cap, the clamping projections rest, when closing the container, at the upper slanted surface and, when removing the closure cap, at the lower slated surface of the grooves. Accordingly, for closing the container as well as for opening the container an axial force is employed. The user of the inventive closure arrangement thus must only rotate the closure cap and it is no longer required to pull or push the closure cap. Due to the forced guiding of the closure cap, the rotary movement of the closure cap results at the same time in an axial movement. Thus, the closure cap can be removed even at locations that are difficult to access.

BRIEF DESCRIPTION OF THE DRAWING

The object and advantages of the present invention will appear more clearly from the following specification in conjunction with the accompanying drawing, in which.

DESCRIPTION OF THE PREFERRED EMBODIMENTS

Figure 2:
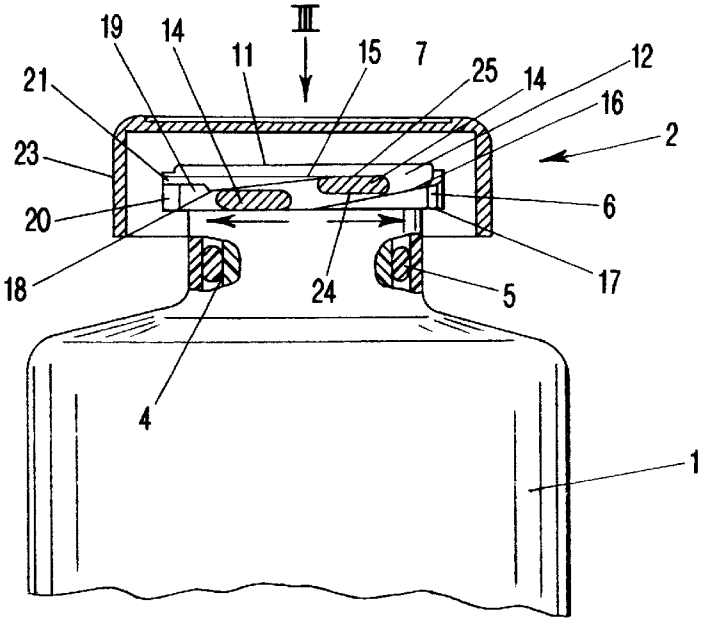
FIG. 2 shows in a representation corresponding to FIG. 1 the inventive closure arrangement with the closure cap in a partially removed position.
Figure 3:
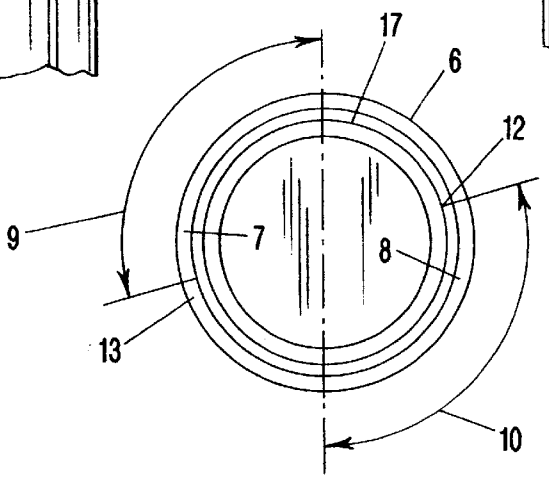
FIG. 3 is a view in the direction of arrow III of FIG. 2 onto the container neck opening
Figure 1:
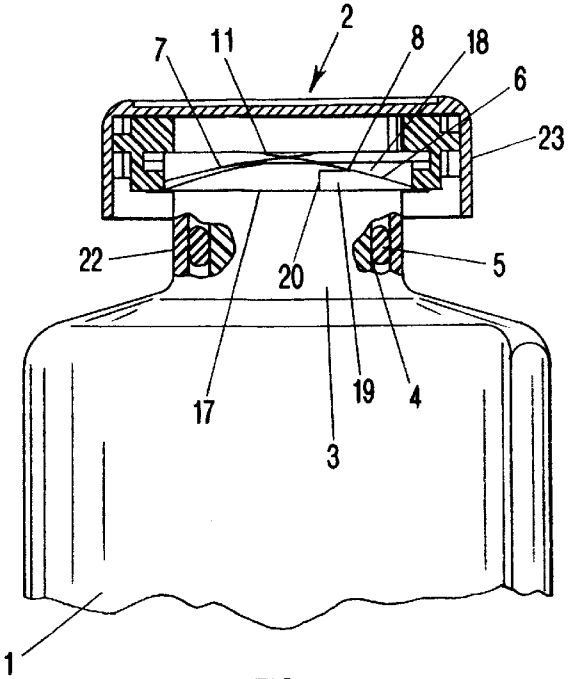
FIG. 1 shows the inventive closure arrangement partly in a side view and partly in section with the closure cap being in the locked position.

The present invention will now be described in detail with the aid of several specific embodiments utilizing FIGS. 1–3.

The closure arrangement serves to close a container 1 by a closure cap 2. The container 1 receives liquid media, for example, hydraulic oil, with which, for example, devices in motor vehicles such as power steering devices are actuated. The container 1 has a neck 3 which, in comparison to the remaining container, has a smaller cross-section. An insert 22 on the closure cap 2 projects into the container neck 3. The insert 22 has an annular groove 4 in which a sealing ring 5, preferably an O-ring, is received. It is clamped within the annular groove 4 upon closing the closure cap 2 in a manner to be disclosed in the following. The free rim 6 of the container neck 3 is wider than the remaining part of the neck 3 so that it projects radially from the neck 3. At diametrically opposed locations the projecting rim 6 is provided with a respective groove 7, 8 which extends over an angular circumferential area 9 and 10 of more than 90°, preferably more than 100°. In FIG. 2 only the groove 7 is visible. In FIG. 1 the two grooves 7, 8 are only represented by curved lines. The two grooves 7, 8 extend in their shown embodiment over an angular distance 9, 10 of respectively 105° (FIG. 3). As FIG. 2 shows for the groove 7, the grooves open into the end face 11 of the rim 6. Accordingly, at the end face of the projecting rim 6 two thread segments 12 and 13 (FIG. 3) are positioned diametrically opposed to one another into which the clamping projections 14 of the closure cap 2 can be placed. In FIG. 2 the two clamping projections 14 are shown in cross-section, whereby the closure position is indicated (arrow pointing to the left) and also the release or open position (arrow pointing to the right).

The two grooves 7, 8 are thread segments which advantageously are embodied as flat threads. From FIG. 2 it can be taken for the groove 7 that the two slanted surfaces 15 and 16 delimit the groove 7. The slanted surfaces extend parallel to one another at a spacing from the end face 11 of the rim 6. The slanted surface 16 extends to the planar bottom side 17 of the rim 6. The other slanted surface 15 extends to approximately half the height of the rim 6 to a nose-shaped projection 18 which projects in the direction toward the bottom side 17 of the rim 6. Adjacent to the projection 18 the cutout 19, open toward the bottom side 17, is positioned which in the circumferential direction is delimited by a radially extending end wall 20. The cutout 19 is delimited by a wall 21 extending parallel to the end face 11 from the projection 18 to the end wall 20.

The other groove 8 is embodied in an analogous manner. In FIG. 2, in which the container 1 with a closures cap 2 is represented in a position rotated by 90° relative to FIG. 1, the end wall 20, the projection 18, and the cutout 19 open toward the bottom side 17 are clearly illustrated.

The closure cap 2 projects with its insert 22 into the container neck 3. The insert 22 is covered over a portion of its height at a distance by a cylindrical closure cap rim 23. Within the area of the closure cap surrounded by the closure cap rim 23 the two diagonally opposed clamping projections 14 are provided. In FIG. 2, the clamping projections 14 are shown in two different positions. The respective lengths of the clamping projects 14 are such that a portion of their undersides 24 and a portion of their respective upper sides 25 rest upon the two slanted surfaces 15, 16 ,of the respective grooves 7, 8. The width of the groove 7, 8 of the circumferential direction matches for a quadrangular cross-section of the clamping projections 14 the diagonal of the cross-section of the clamping projections. The closure cap 2 is placed onto the container neck 3 such that the clamping projections 14 are inserted into the two grooves 7, 8 through the thread segments 12, 13. A precise positioning of the closure cap 2 is not necessary. The closure cap 2 is rotated such that the clamping projections 14 with their boftom edge glide along the two slanted surfaces 16 of each one of the grooves 7, 8 until they contact and glide with their upper edge along the slanted surfaces 15 and then reach the projections 18 at the end of the slanted surface 15. In FIG. 2, a position is shown for the damping projection 14 in which it is positioned directly in front of the projection 18. Upon further rotation of the closure cap 2 the clamping projections 14 will glide under the projections 18 and then are received in the cutout 19 until they come to rest at the end walls 20 of the cutouts 19. The end walls 20 thus provide stops for the closure cap 2 so that it is received in a defined position on the container neck 3. Since the grooves 7, 8 extend spirally, the closure cap 2 and thus also its insert 22 are axially moved during rotation until the closure cap 2 rests directly at the end face 11 of the container neck 3. During rotation for closing and the resulting axial movement of the closure cap 2 the sealing ring 5 is moved along the inner wall of the container neck 3 and is elastically deformed so that it will seal the container 1 in the closed position of the closure cap 2 in a reliable manner. The clamping projections 14 have a width in the circumferential direction preferably such that they extend between the end walls 20 and the projections 18. This prevents that the closure cap 2 can be accidentally released from its closed position.

The slanted surface 16 of the grooves 7, 8 ends at the bottom side of the rim 6 of the container neck 3 at a spacing before the projection 18 of the opposed slanted surface 15. Accordingly, the clamping projections 14 can reach without difficulties the cutouts 19 via the projections 18.

For removing the closure cap 2, it is rotated in the opposite direction whereby the clamping projections 14 are moved across the projections 18 into the grooves 7, 8. Upon further rotation in the reverse direction the clamping projections 14 with their bottom side 24 will come into contact with the slanted surfaces 16 of the grooves 7, 8. Accordingly the closure cap 2, upon rotation in the reverse direction, will be moved axially in the direction toward its release position so that the closure cap 2 can be removed. The grooves 7, 8 extend over an angular distance 9, 10 of more than 100°, in the shown embodiment of approximately 105°. Since adjacent of the grooves 7, 8 in the circumferential direction the cutouts 19 are positioned, the rotary return angle for the closure cap 2 is substantially greater, i.e., is almost 180°. Accordingly, the grooves 7, 8 may have a relatively flat slant of only approximately 9°. This has the advantage that for removal of the closure cap the frictional forces can be easily overcome. When rotating the closure cap 2 for removal, the closure cap is lifted automatically as soon as it reaches the spirally extending grooves 7, 8 so that for opening the container 1 the user must only rotate the closure cap 2. Thus, the closure cap 2 can be opened easily and closed easily even when it is difficult to access it and the cap can be gripped by the user, respectively, a mounting tool only with two or three fingers.

In order to tension, respectively, release the sealing ring 5 during closing or opening of the container 1 in a simple manner, the inner wall of the container neck 3 is advantageously conical above the seat of the ceiling ring. The diameter of the inner wall of the container neck 3 thus increases in the direction toward the closure cap 2. This conical embodiment of the inner wall of the container neck 3 further improves the effect that the closure cap 2 can be removed with minimal force from the container neck 3. In comparison to conventional container closure arrangements, opening the inventive closure arrangement only requires a release force of approximately 10% of a release force required for conventional containers. Due to the spiral extension of the grooves 7, 8, the axial removal forces for removing the closure cap 2 are no longer needed. Moreover, an optimal manipulation of the closure cap 2 for closing and opening the container is provided.

The closure cap 2 can be produced of a suitable material, preferably a plastic material. The container 1 itself can also be produced of a suitable material, for example, a plastic material.

The specification incorporates by reference the disclosure of german priority document 298 03 502.2 of Feb. 28, 1998.

The present invention is, of course, in no way restricted to the specific disclosure of the specification and drawing, but also encompasses any modifications within the scope of the appended claims.

What is claimed is:

1. A closure arrangement for a container, said closure arrangement comprising:

a container neck (3) having a radially projecting rim (6) comprising slanted grooves (7, 8) extending in a circumferential direction of said container neck (3), wherein each one of the grooves (7, 8) is delimited by two opposed slanted surfaces (15, 16);

a wall (21) located on said rim adjacent on of said opposed slanted surfaces extending parallel to a bottom side (17) of said rim;

a cutout (19) in said radially projecting rim (6) open in a direction toward the bottom side delimited by said parallel wall (21), one of said slanted surfaces (16) extending from an end face (11) of said radially proiecting rim to the bottom side (17), and the other of said slanted surfaces (15) beginning at said end face (11); and a removable cap (2) having a clamping projection (14) for each one of said slanted grooves (7, 8), wherein said clamping projection (14) slides in said slanted groove (7, 8) when said cap (2) is removed from or fastened to said container neck (3);

wherein a width of said slanted grooves (7, 8) measured in said circumferential direction matches a size of said clamping projections (14) measured in said circumferential direction.

2. A closure arrangement according to claim 1, wherein said slanted surfaces (15,16) of each one of said slanted grooves (7, 8) are thread segments.

3. A closure arrangement according to claim 1, wherein said slanted grooves (7, 8) open into said end face (11) of said container neck (3) facing said closure cap (2).

4. A closure arrangement according to claim 1, wherein said slanted grooves (7, 8) have a slant angle of between 7° and 12°.

5. A closure arrangement according to claim 4, wherein said slant angle is approximately 9°.

6. A closure arrangement according to claim 1, wherein each said slanted surface (15, 16) extends over a circumferential angle (9, 10) of more than 90°.

7. A closure arrangement according to claim 6, wherein each said slanted surface (15, 16) extends over a circumferential angle (9, 10) of more than 100°.

8. A closure arrangement according to claim 1, wherein one of said slanted surfaces (15) ends at said parallel wall (21).

9. A closure arrangement according to claim 8, wherein said cutout (19) is delimited in said circumferential direction by an end wall (20).

10. A closure arrangement according to claim 8, wherein said wall (21) has a projection (18) where said other slanted surface (15) meets said wall (21).

11. A closure arrangement according to claim 1, wherein said clamping projections (14) have a rectangular cross-section.

12. A closure arrangement according to claim 11, wherein said clamping projections (14) have rounded corners.

13. A closure arrangement according to claim 1, wherein said closure cap (2) has an insert (22) projecting into said container neck (3).

14. A closure arrangement according to claim 13, wherein said insert (22) has an outer circumferential annular groove (4) and has an o-ring (5) positioned in said groove (4).

15. A closure arrangement according to claim 14, wherein said container neck (3) has an end face facing said closure cap (2) and has an inner wall widening toward said end face (11) at least in an area above said annular groove (4).

* * * * *